US006950003B2

(12) United States Patent
Ahulwalia et al.

(10) Patent No.: US 6,950,003 B2
(45) Date of Patent: Sep. 27, 2005

(54) DEVICE USEFUL FOR SIGNAL TRANSFER FROM STATIC SURFACE TO ROTATING SURFACE AND VICEVERSA

(75) Inventors: Surjit Singh Ahulwalia, Chandigarh (IN); Sanjeev Verma, Chandigarh (IN); Sunil Ratan Taneja, Chandigarh (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/403,547

(22) Filed: Mar. 31, 2003

(65) Prior Publication Data

US 2004/0189428 A1 Sep. 30, 2004

(51) Int. Cl.[7] ..... H01F 24/06
(52) U.S. Cl. ..... 336/118; 336/115; 336/83
(58) Field of Search ..... 336/83, 115, 117–119, 336/214–215, 178, 223, 188

(56) References Cited

U.S. PATENT DOCUMENTS 4,560,928 A * 12/1985 Hayward ..... 324/172
4,701,674 A * 10/1987 Oono et al. ..... 315/276
5,656,983 A * 8/1997 Ito et al. ..... 335/297
5,719,546 A * 2/1998 Ito et al. ..... 336/180
5,814,900 A * 9/1998 Esser et al. ..... 307/104
6,040,986 A * 3/2000 Sakamoto et al. ..... 363/21.02
6,580,267 B2 * 6/2003 Logue et al. ..... 324/240

* cited by examiner

*Primary Examiner*—Anh Mai
(74) *Attorney, Agent, or Firm*—Harness Dickey & Pierce PLC

(57) ABSTRACT

A device useful for transferring signals from static surface to a rotating surface, said device comprising a pair of pot cores acting as a primary and secondary core and said primary pot core being wound with 'N1' number of turns and said secondary pot core being wound with 'N2' number of turns of a conducting wire respectively, such that each turn of the wire rests on top of the previous turns thereby increasing inner diameter of the pot core by a wire thickness each time, one of the said pot core is mounted on a rotating surface and the other pot core being fixed to a static surface with minimum air gap between each other such that the coils are always facing each other even if the primary and the secondary cores are rotated through 0 to 360° with respect to each other.

10 Claims, 6 Drawing Sheets

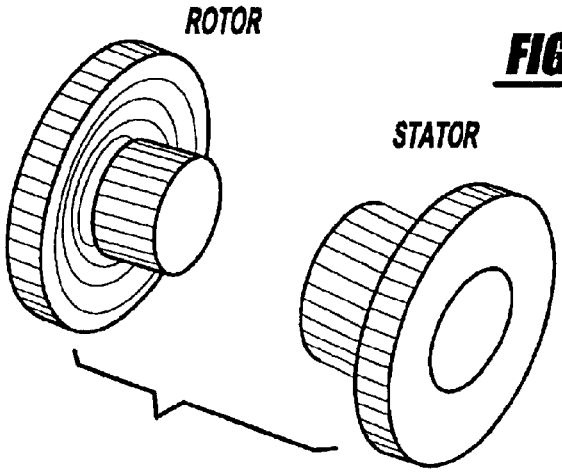
FIG - 1A
FIG - 1B
TRANSFORMER USING POTCORES
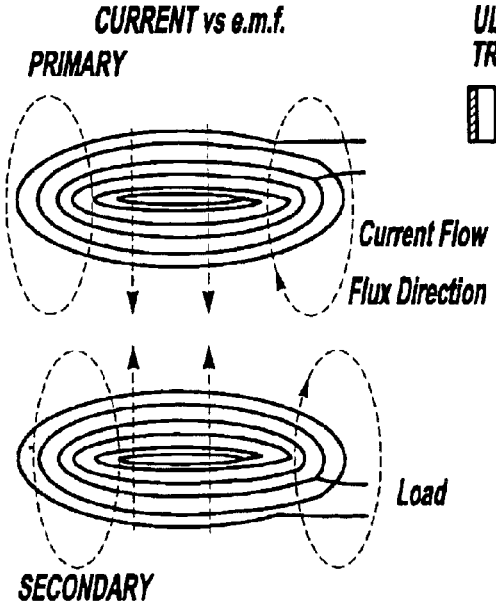
FIG - 1C
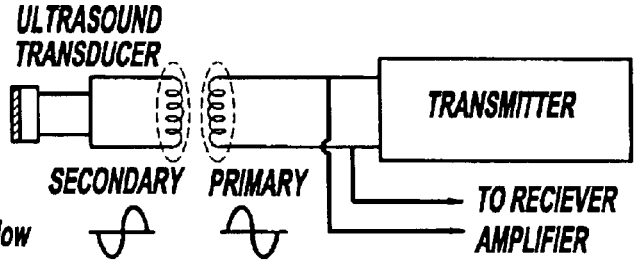
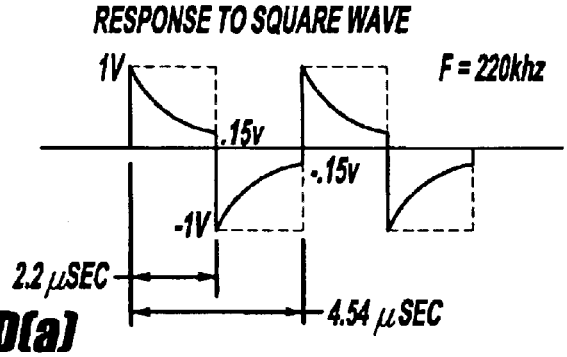
FIG - 1D(a)
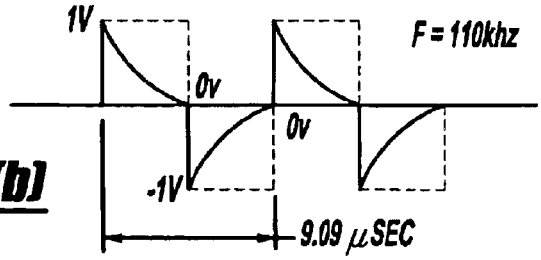
FIG - 1D(b)

ASSEMBLED VIEW OF SCANNER PROBE

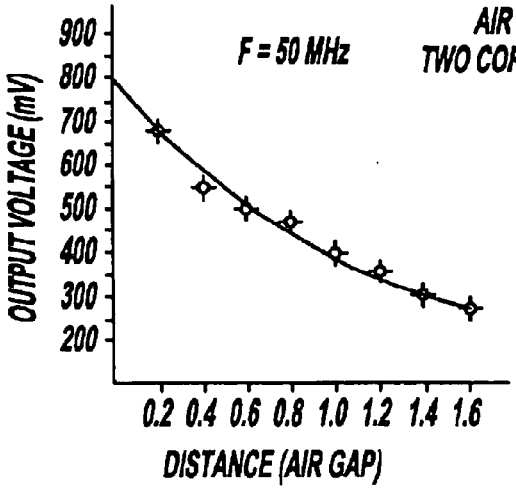
FIG - 3A
FIG - 3B
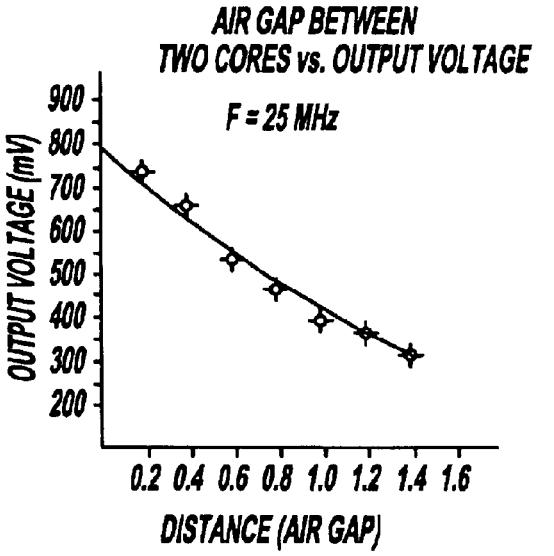
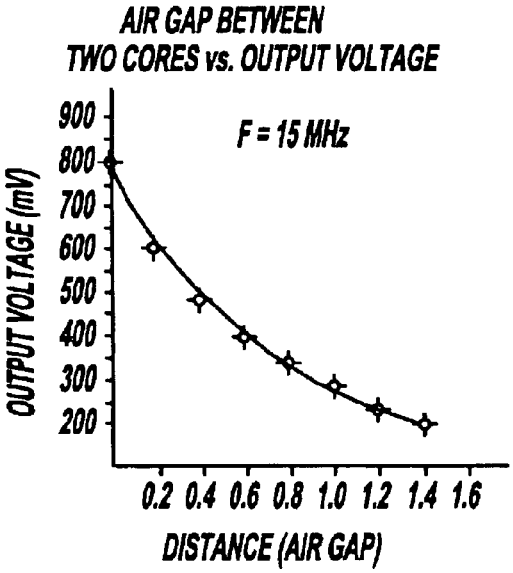
FIG - 3C
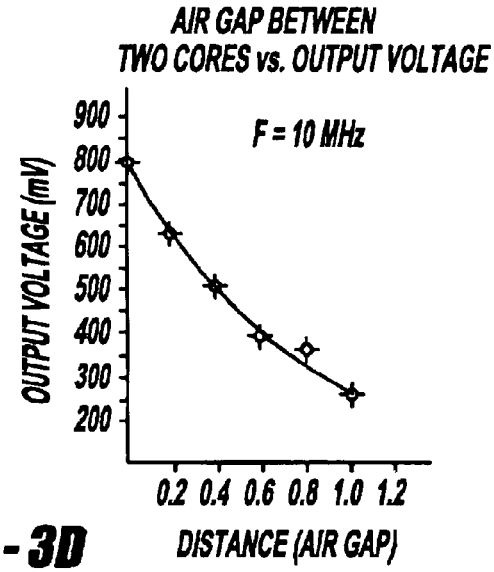
FIG - 3D

DEVICE USEFUL FOR SIGNAL TRANSFER FROM STATIC SURFACE TO ROTATING SURFACE AND VICEVERSA

FIELD OF THE INVENTION

The present innovation relates to a device useful for signal transfer from static surface to rotating surface and vice-versa. The device can be used in a variety of applications wherein signal transfer from static surface to rotating surface and vice-versa is required for example, for exciting rotating piezoelectric crystals mounted on mechanical rotating scan head, receiving the echoes picked up by rotating crystal and transferring to static surface with very high efficiency provided the air gap between the two surfaces is small. This device of the present invention can also be used for signal isolation in electronic circuits for ground loop minimization etc.

BACKGROUND OF THE INVENTION

The early method of signal transfer from static surface to rotating surface was through the use of carbon brushes, spring loaded contractors, gold slip rings or ball bearings. These methods however, lost ground with time-because of frictional wear, noise generation etc.

The modern method to achieve the above objective is with a rotating transformer normally used in video cassette recorders (VCR's). It consists of two wire wound discs of ferrites. One wire wound disc is connected on the stator (primary) and second were wound disc is connected on rotor (secondary) with windings facing each other. The distance between stator and rotor is very small. Signal transfer from static surface to rotating surface and vice-versa is via these primary secondary transformer based on magnetic flux linkage. It depends upon the current induced in the windings, ferrites used in the set up, turns ratio, air gap between primary and secondary etc.

Some Japanese companies are believed to be making such VCR rotating transformers. However, a major limitation is that these companies are only interested in supplying these items in bulk quantities. In addition VCR cores are not available separately and ferrites cannot be trimmed by machining. The companies do not provide their characteristics and other design details etc. The other sources of supply of these items are generally not known.

OBJECTS OF THE PRESENT INVENTION

The main object of the present invention is to provide a device useful for signal transfer from static surface to rotating surface and vice-versa.

Another object of the present invention is to provide a device useful for signal transfer from static surface to rotating surface and vice-versa with even response throughout 360° rotation of secondary w.r.t primary wound core.

Yet another object of present innovation is to provide a replacement for the VCR rotating transformer.

BRIEF DESCRIPTION OF THE ACCOMPANYING DRAWINGS

In the drawings accompanying this specification,

FIGS. 1(A–G) represents the device of the present invention.

More specifically,

FIG. 1(A) represents the Rotor and Stator parts of the device useful for transferring signals from a static surface to a rotating surface or vice-versa.

FIG. 1(B) represents the basic block diagram representing the transformer.

FIG. 1(C) represents the directions of the current in the primary secondary and the magnetic flux generated as determined by applying Fleming's Right Hand Rule.

FIG. 1(D) represents the response of the device of the; present invention to square waves.

SUMMARY OF THE PRESENT INVENTION

Figure 1E:
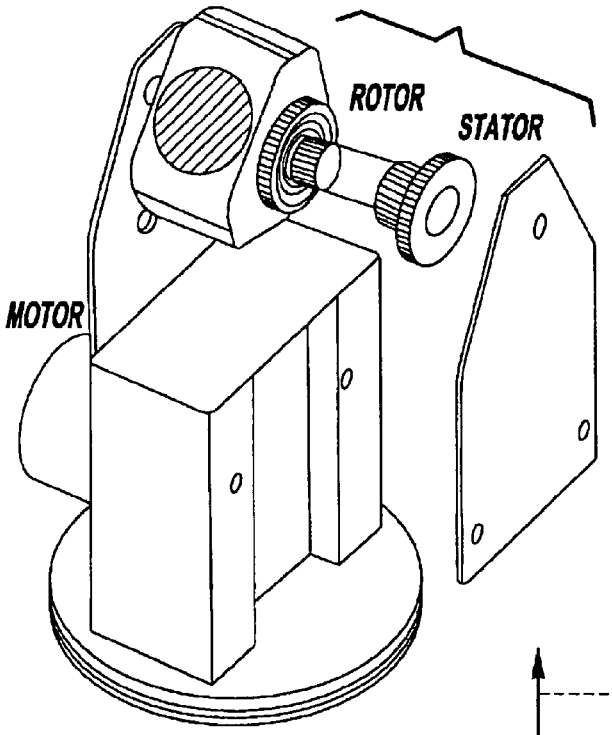
FIG. 1(E) represents the assembled view of a scanner probed fitted with the device of the present invention.

Accordingly, the present invention provides a device useful for transferring signals from static surface to a rotating surface, said device comprising a pair of pot cores (9X5; 9 mm OD, 1.5 mm ID) acting as a primary and secondary core, said pot cores being wound with 6 to 7 turns of SWG 36 copper wire such that each turn of copper wire rests on top of the previous turns thereby increasing in diameter by wire thickness, one of the said pot core is mounted on the rotating surface and the other pot core is fixed to a static surface with minimum air gap between each other such that the coils are always facing each other even if the primary and the secondary cores are rotated through 0 to 360° with respect to each other.

DETAILED DESCRIPTION OF THE PRESENT INVENTIONS

The present invention relates to a device useful for signal transfer from static surface to rotating surface & vice-versa which comprises a small transformer with a special pot core having 'N1' number of turns-at primary and 'N2' number of turns at secondary wound in a special way on a readily available pot cores with wire wound faces facing each other with minimum distance with either primary/secondary on a static/rotating surface or vice-versa resulting in a very efficient device.

In an embodiment of the present invention, the device provides a wide −3 dB bandwidth (100 kHz to 10 MHz with 9X5 CEL pot core).

In another embodiment of the present invention, the device provides a wide dynamic range (1–2 $\mu$v to 500 v pulse of 300 ns).

In yet another embodiment of the present invention, no noise is generated during the operation of the device, as there is no physical contact between the surfaces. So it has a very long life.

In still another embodiment of the present invention, a set of Pot cores are wound with V number of turns wherein each turn rests on top: of the previous turns thereby increasing in diameter by wire thickness with each turn. The number of turns, 'V' depends upon the inside space of pot core. Increase in the number of turns 'V' of secondary compared to primary increases signal strength by ratio of turns and vice-versa. With equal number of turns on primary & secondary, the signal from primary goes to secondary with 90% efficiency with small air gap and 180° phase shift w.r.t primary.

In one more embodiment of the present invention, the air space between primary and secondary, should be as small as possible for maximum efficiency. The minimum air gap is defined whereby secondary wound core in the device should move freely in front of primary wound core.

In one another embodiment of the present invention, the effect of rotation of such a device w.r.t each other throughout 360° angle has no effect on the strength of signal transferred.

The novelty of the present invention lies in choosing the core of the device. A set of commonly available pot cores each wound with a particular number of turns of copper wire constitute the device of the present invention. This set up yields a wide band −3 dB response in ultrasonic range (100 KHz to 10 MHz with PX5 pot core). The efficiency of device is around 90% in combined transmit/receive mode. The device has a very wide dynamic range (from 1–2 $\mu$v to 500 v pulse) and the response is even throughout 360° rotation of secondary w.r.t primary wound core.

Accordingly the present innovation provides a device useful for signal transfer from static surface to rotating surface and vice-versa which comprises a small transformer with a special core having 'N1' number of turns at primary and 'N2' number of turns of secondary wound in a special way on a readily available pot cores such that the wire wound faces face each other with minimum distance with either primary/secondary on a static/rotating surface or vice-versa resulting in a very efficient device.

Figure 1F:
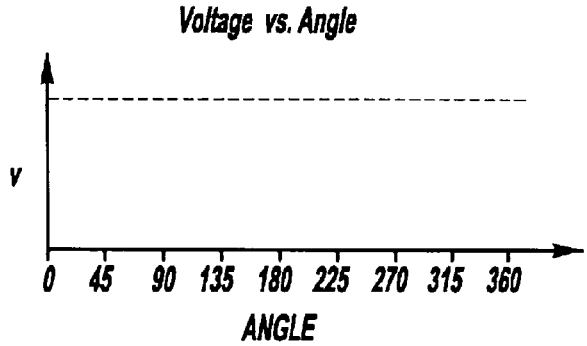
FIG. 1(F) represents the voltage induced in the secondary coils when the primary coil is rotated by an angle between 0° to 360°.
Figure 1G:
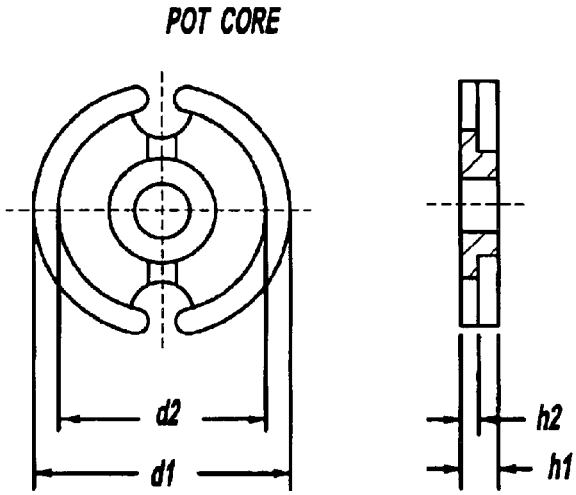
FIG. 1(G) represents the novel pot core used in the present invention as the transformer core.

The above objective is achieved by using a small pot core (9X5; 9 mm OD, 1.5 mm ID as shown in FIG. 1-G manufactured by M/S CEL, Ghaziabad) as its base material and keeping 6 turns (N=6) of SWG 36 copper wire each on primary and secondary. If a bigger pot core is used, the thickness of copper wire has to be increased to accommodate 6/7 turns each on primary and secondary. The number of turns depends upon the inside space of pot core and the copper wire is wound in such a way that each turn rests on top of the previous turns thereby increasing in diameter by wire thickness. Increase in the number of turns of secondary compared to primary increases signal strength by ratio of turns and vice-versa.

Principle of Operation

When alternating current flows in the circular coil of primary winding, magnetic flux is generated, the strength of the magnetic flux thus generated depends on magnitude of current. The direction of the magnetic flux thus generated can be found by applying Fleming's Right Hand Rule (FIG. 1-C). The flux strength is enhanced manifolds if the winding is on a magnetic material such as ferrites. This flux induces an e.m.f. in the opposite direction in a secondary coil which is 180° out of phase with the primary (FIG. 1-B). Thus, the primary and secondary parts: of this device can be connected on stator/rotor with a little air gap, thus allowing small electrical signals to transfer from the stator to moving rotor and vice-versa. To keep the voltage gain to unity approximately, both primary and secondary coils should have the same number of turns of the coil.

The novelty of the present invention also lies in the fact that the rotation of the primary and secondary coils with respect to each other through 0° to 360° does not have any effect on the e.m.f. induced. The Applicants have arrived at this feature by choosing a core which is circular in shape. As the pot core is circular in shape, the coil wound on the core is also circular in shape. Thus, the coils are always facing each other even the primary and the secondary are rotated through 0 to 360° with; respect to each other as shown in FIG. 1-F.

Thus, it was observed that the effect of rotary motion of primary or secondary has no effect on induced e.m.f.

The number of turns depends upon the inside space of pot core and the copper wire is wound in such a way that each turn rests on top of the previous turns thereby increasing the inner diameter of the core by a wire thickness each time. This arrangement results in maximum flux linkage with the secondary winding infront of it thus resulting in very high efficiency when air: gap is small. A readily available pot core 9X5 from CEL, Ghaziabad constitute the core of such a device. The two sides of pot core wound with copper wire form primary and secondary of device with wire wound faces facing each other.

The developed device can be used in a: variety of applications such as signal transfer from static surface to rotating surface and vice-versa e.g. for exciting rotating piezoelectric crystals mounted on mechanical rotating scan head, receiving the echoes picked up by rotating crystal and transferring to static surface with very high efficiency provided the air gap between the two surfaces is small. This device can also fee used for signal isolation in electronic circuits for ground loop minimization etc.

The present invention is further described with respect to the following examples which are given by way of illustration and hence, should not be construed to limit the scope of the present invention in any manner.

EXAMPLE-1

The primary of the device is connected to the transmitter and also to the receiving amplifier. The secondary of the device is connected to a piezoelectric transducer as shown in FIG. 1B. There is a narrow air gap between the primary and the secondary of the device. The device is connected in such a way that the coils are facing each other. The primary is supported in the static probe frame. The secondary is fixed in the piezoelectric, transducer housing in such a way that axis of transducer passes through it so that transducer can move freely as shown in FIG. 1E. This is applicable for both rotating type ultrasonic transducer and rocking type ultrasonic transducer probes.

The transmitter generates narrow pulse (50–300 nsec) of high voltage (500 v). This pulse excites the primary winding which converts this electrical impulse to magnetic flux, which induces a proportional current in the secondary winding. This secondary current impulse excites the piezoelectric transducer which sends mechanical vibration in the body. The received echoes are picked up by the transducer inducing proportional current in the secondary, generating flux proportional to echoes which gets linked to primary winding from where receiving amplifier picks up the signal for further processing. This way the device helps to transfer signal from static device to rotating device and back to static device. The efficiency of device is around 90% compared to direct wire connector circuit. Signal remains pure as brushes or ball bearing are not used which is normally the method in such cases which generate noise and also rubbing is avoided resulting in better output and longer life.

EXAMPLE-2

Ground isolation: This can be effectively used to isolate a signal. Sometimes while working with high frequencies, ground loops are created which degrade the performance of the circuit. By isolating the ground the problem can be solved at higher frequencies also which otherwise has very limited options. The signal however undergoes a 180° phase shift with slight decrease in amplitude.

Characteristics

Figure 2:
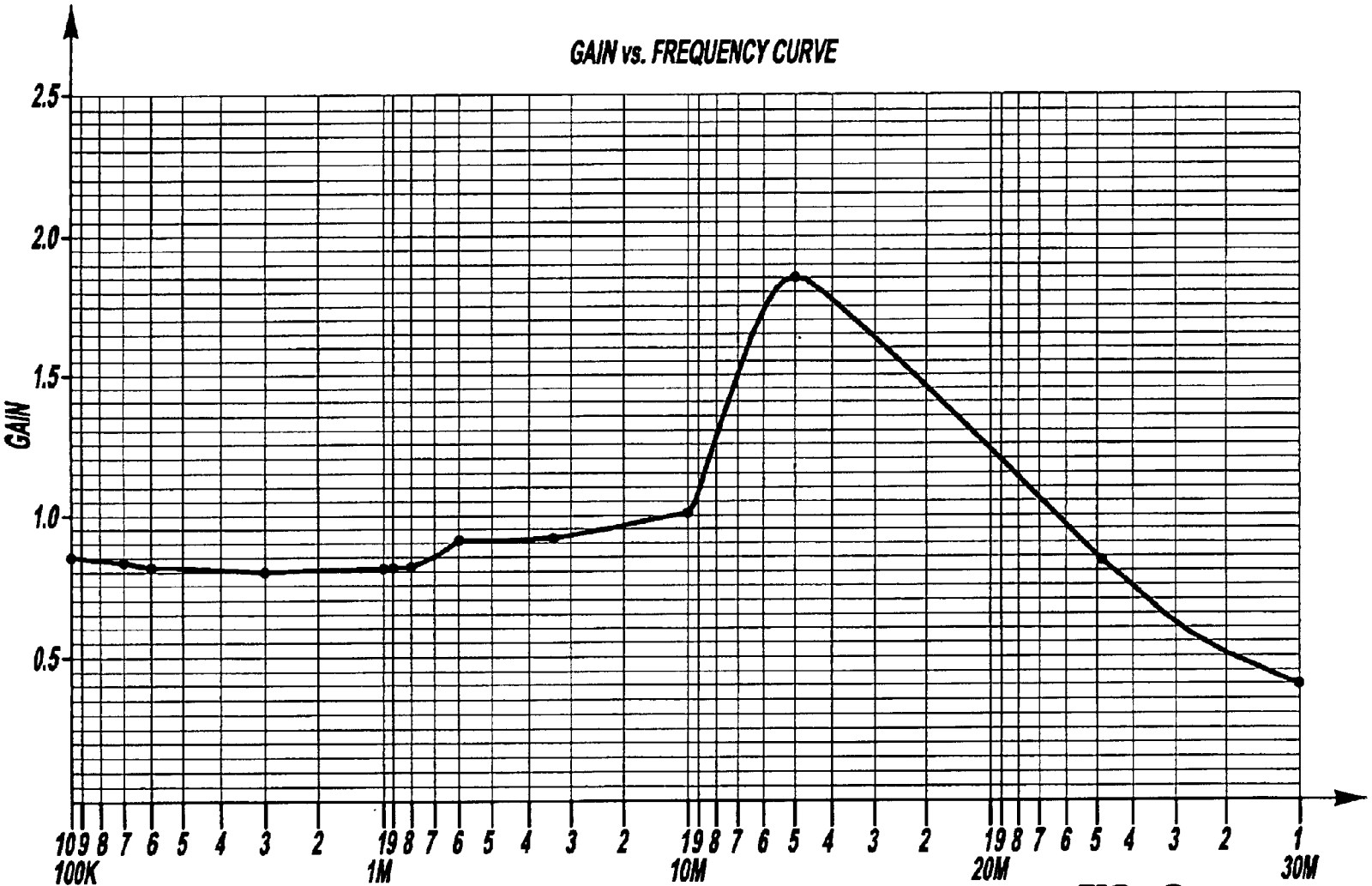
FIG. 2 shows the frequency response obtained using the novel core.
Figure 3E:
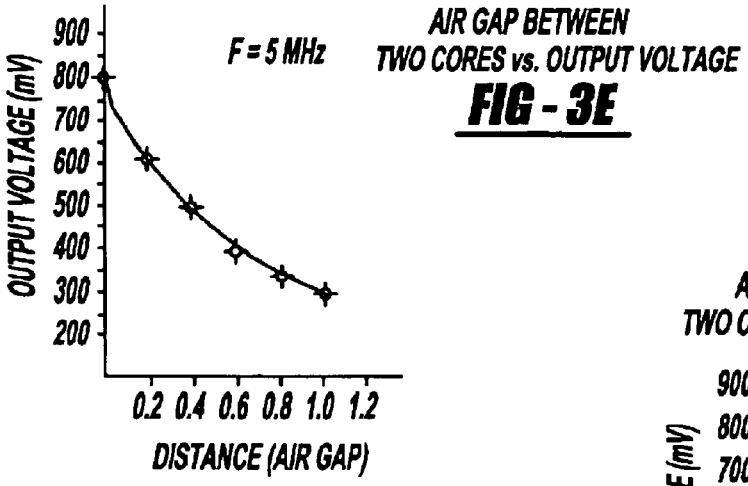
FIG. 3 shows the characteristics due to change in air gap at various frequencies.
Figure 3F:
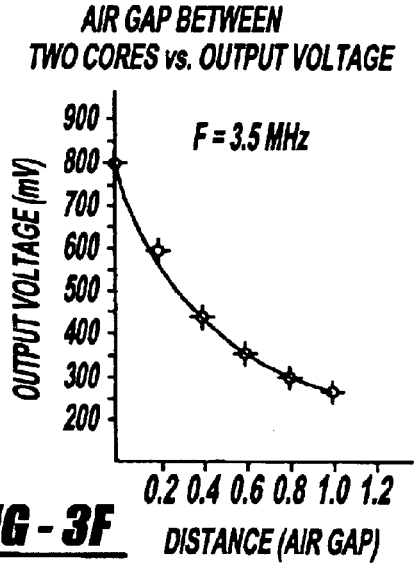
Figure 3G:
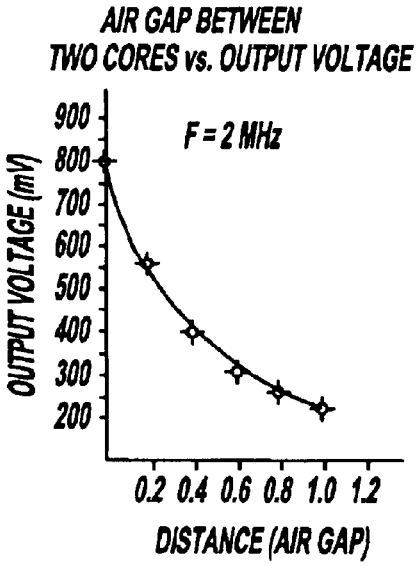
Figure 3H:
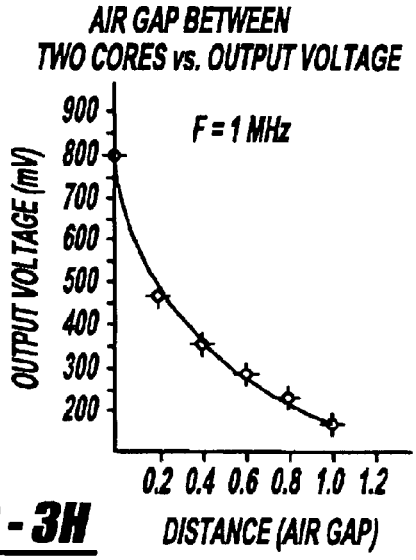
Figure 3I:
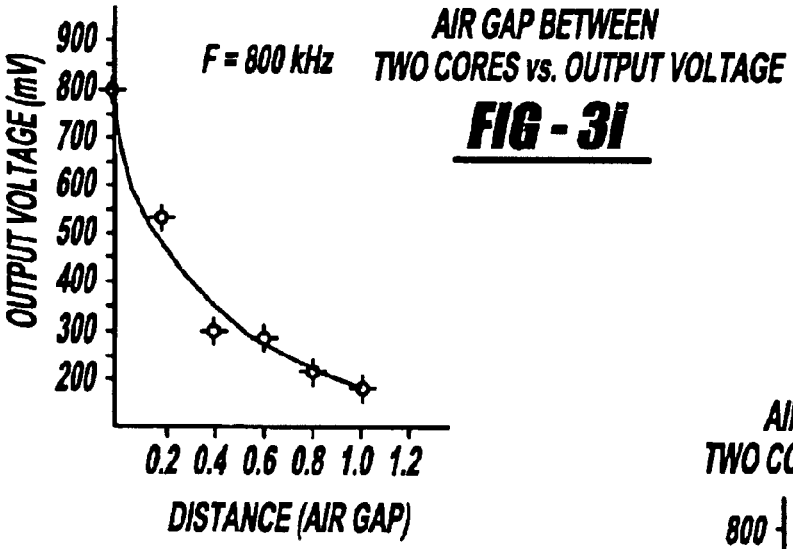
Figure 3J:
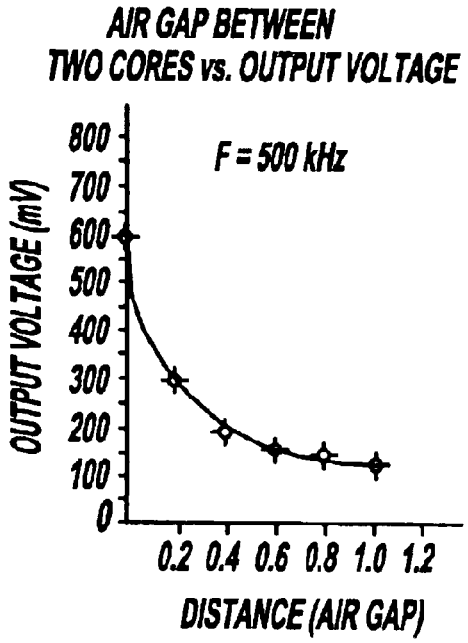
Figure 3K:
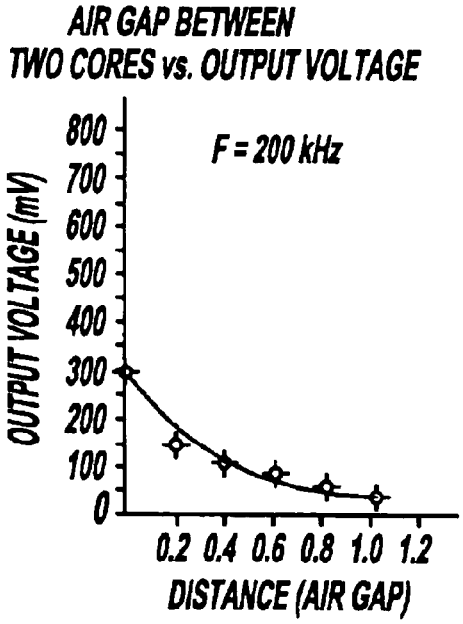

FIG. 2 shows the frequency; response due to this 9X5 CEL core. The gain is between 0.86 to 1 from 100 k to 10

MHz. The diagnostic ultrasound range is 1 MHz to 10 MHz. Thus we have been able to get near ideal response in the diagnostic useful ultrasound range. This flat response can be effectively used to transfer signal from static surface to rotating surface for a variety of applications in systems working in ultrasound range of 100 kHz–10 MHz.

FIG. 3 shows the characteristics due to change in air gap, which shows that the least gap should be preferred for better results. Response from 200 KHz to MHz is shown. Response to square-wave is shown in FIG. 1-D. Due to poor frequency response at lower frequencies, the waveform looks differentiated.

Advantages of the Present Invention

The main advantages of the present innovation are:

1. A better alternative of rotating transformers.
2. Wide—3 dB bandwidth from 100 KHz to 10 MHz making it ideal even for wideband multifrequency transducers. Excellent response in ultrasonic diagnostic range of 1–10 MHz.
3. Wide dynamic range, output of a few micro volts (1–2 $\mu$v) to 500 volts pulse (of 300 nsec pulse width under testing).
4. No noise generating component, pure transmission depending on magnetic flux linkage.
5. No wear/tear of parts. No direct contact among surfaces. So very long life.
6. Light Weight, winding/construction is easy.
7. Even response throughout 360° rotation.

What is claimed is:

1. A device for transferring signals from static surface to a rotating surface and vice versa with above 90% efficiency, said device comprising a pair of pot cores acting as a primary and secondary cores, wherein the primary pot core being wound with 'N1' number of turns and said secondary pot core being wound with 'N2' number of turns of a conducting SWG 36 copper wire respectively, such that each turn of the wire rests on top of the previous turns, thereby increasing inner diameter of the pot core by a wire thickness each time, one of the said pot core is mounted on a rotating surface and the other pot core being fixed to a static surface with minimum air gap between each other such that the coils are always facing each other, even if the primary and the secondary cores are rotated through 0 to 360° C. with respect to each other.

2. A device as claimed in claim 1, wherein the conducting wire is SWG 36 copper wire.

3. A device as claimed in claim 1, wherein the number of turns on the primary pot core may be less than or equal to or greater than the number of turns on the secondary pot core.

4. A device as claimed in claim 1, wherein the number of turns on the primary and secondary pot cores are equal.

5. A device as claimed in claim 1, wherein the primary and secondary pot cores are wound with 5 to 8 turns of the copper wire.

6. A device as claimed in claim 1, wherein the device provides a wide −3 dB bandwidth in the range of 100 kHz to 10 MHz with 9X5 CEL pot core.

7. A device as claimed in claim 1, wherein the device provides a dynamic range in the range of 2 $\mu$v to 500 v pulse of 300 ns.

8. A device as claimed in claim 1, wherein there is no physical contact between the primary and secondary cores.

9. A device as claimed in claim 1, wherein the efficiency of the device is above 90%.

10. A device as claimed in claim 1, wherein the efficiency of the device is above 90% in combined transmit/receive mode.

* * * * *

UNITED STATES PATENT AND TRADEMARK OFFICE

CERTIFICATE OF CORRECTION

PATENT NO. : 6,950,003 B2
DATED : September 27, 2005
INVENTOR(S) : Surjit Singh Ahluwalia et al.

It is certified that error appears in the above-identified patent and that said Letters Patent is hereby corrected as shown below:

Title page,
Item [12], delete "Ahulwalia" and replace with -- Ahluwalia --.
Item [75], Inventors, delete "Ahulwalia" and replace with -- Ahluwalia --.

Column 1,
Line 30, delete "were" and replace with -- wire --.

Column 2,
Line 6, delete "the;" and replace with -- the --.
Line 36, delete "INVENTIONS" and replace with -- INVENTION --.
Line 59, delete "top;" and replace with -- top --.

Column 3,
Line 50, delete "parts;" and replace with -- parts --.
Line 64, delete "with;" and replace with -- with --.

Column 4,
Line 7, delete "air:" and replace with -- air --.
Line 12, delete "a:" and replace with -- a --.

Column 5,
Line 33, second occurrence, after "as" delete "a".

Signed and Sealed this

Ninth Day of May, 2006

JON W. DUDAS
*Director of the United States Patent and Trademark Office*